US006551084B2

(12) United States Patent
Sundström

(10) Patent No.: US 6,551,084 B2
(45) Date of Patent: Apr. 22, 2003

(54) SCREW ROTOR MACHINE HAVING MEANS FOR AXIALLY BIASING AT LEAST ONE OF THE ROTORS

(75) Inventor: Mats Sundström, Ingaro (SE)

(73) Assignee: Svenska Rotor Maskiner AB, Stockholm (SE)

( * ) Notice: Subject to any disclaimer, the term of this patent is extended or adjusted under 35 U.S.C. 154(b) by 0 days.

(21) Appl. No.: 10/139,107

(22) Filed: May 3, 2002

(65) Prior Publication Data

US 2002/0131885 A1 Sep. 19, 2002

Related U.S. Application Data

(63) Continuation of application No. PCT/SE00/02034, filed on Oct. 20, 2000.

(30) Foreign Application Priority Data

Nov. 11, 1999 (SE) ..... 9904069

(51) Int. Cl.[7] ..... F01C 1/16
(52) U.S. Cl. ..... 418/203; 415/105
(58) Field of Search ..... 418/203; 415/105

(56) References Cited

U.S. PATENT DOCUMENTS

| | | | | |
|---|---|---|---|---|
| 2,590,560 A | | 3/1952 | Montelius | 418/203 |
| 2,590,561 A | | 3/1952 | Montelius | 418/203 |
| 4,964,790 A | | 10/1990 | Scott | 418/203 |
| 5,135,374 A | | 8/1992 | Yoshimura et al. | 418/203 |
| 5,281,115 A | * | 1/1994 | Timuska | 418/203 |
| 5,707,223 A | * | 1/1998 | Englund et al. | 418/203 |

FOREIGN PATENT DOCUMENTS

| | | |
|---|---|---|
| DE | 195 08 561 A1 | 9/1996 |
| EP | 0 405 161 B1 | 1/1991 |
| GB | 1 549 546 | 8/1979 |

* cited by examiner

*Primary Examiner*—John J. Vrablik
(74) *Attorney, Agent, or Firm*—Frishauf, Holtz, Goodman & Chick, P.C.

(57) ABSTRACT

A helical screw rotor machine is provided which has at least one trunnion having an axial thrust surface located in a chamber filled with pressure medium and actuated axially by the pressure medium. A casing is closely fitted around the trunnion. The casing has an outer end which is connected to a bottom wall that includes a hole in its center, and the casing is rotatably and slidably mounted on the trunnion and is movable between a first axial position in which the bottom wall is spaced from an end wall of the chamber and a second axial position in which the bottom wall is in abutment with said end wall. A supply channel is connected to an opening in the end wall of the chamber opposite the hole in the bottom wall of the casing for controlled delivery of the pressure medium into the casing.

20 Claims, 4 Drawing Sheets

SCREW ROTOR MACHINE HAVING MEANS FOR AXIALLY BIASING AT LEAST ONE OF THE ROTORS

This is a Continuation Application of PCT Application No. PCT/SE00/02034 filed Oct. 20, 2000, the entire contents of which are incorporated herein by reference.

FIELD OF THE INVENTION

The present invention relates to a rotor machine, and particularly to a helical screw rotor machine which comprises a housing in which at least one rotor provided with trunnions is enclosed in a working space that includes an inlet port and an outlet port, wherein the working space is delimited by a low pressure end-section, a high pressure end-section and a barrel section extending between the end-sections, wherein the trunnions extend into bearings disposed in the end-sections, and wherein at least one of the trunnions extends through an associated end-section and presents an axially projected thrust surface in a delimited chamber which contains means for creating a force that acts axially on the thrust surface.

BACKGROUND OF THE INVENTION

When such helical screw rotor machines are designed to function as compressors, the working medium is compressed to a higher pressure level, whereas when such machines are designed to expand the working medium, the working medium is expanded from an elevated pressure level. For the sake of simplicity, solely the former case will be dealt with, i.e. the case when the machine functions as a compressor, although the following discussion also applies to the same degree with respect the case when the machine functions as an expander.

In a helical screw rotor compressor, the working medium is compressed in V-shaped working chambers. During a filling phase, each working chamber is in communication with an inlet port disposed at the low pressure end. When communication with the inlet port has been broken, the volume of the working chamber decreases as a result of said chamber being moved in a direction towards the high pressure end by rotation of the rotors, thereby compressing the working medium enclosed in the working chamber. When the working chamber is moved axially towards the high pressure end to an extent such as to begin to communicate with the outlet port, an emptying phase commences, during which continued reduction in the volume of the working chamber forces the working medium out through the outlet port at an elevated pressure level. Thus, the rotors are exposed to a higher pressure at their high pressure end than at their low pressure end, meaning that each rotor is subjected to thrust in a direction towards the low pressure end. These thrust forces are taken up by thrust bearings mounted in one or both end sections.

Some working medium will also leak out from the high pressure end around the trunnions and enter the bearing chamber in the high pressure end-section. In order to avoid the build-up of high pressure, on a level with the outlet pressure, in the bearing chamber, said chamber is normally provided with a relief channel that leads the working medium back to a closed working chamber in which the pressure at one level is slightly higher than the inlet pressure. This channel is also intended to allow oil to circulate through the rotor bearings. As a result, the pressure in the bearing chamber will be on the level of the pressure in said closed working chamber. This pressure exerts a force on the end surfaces of the rotor trunnions, which is also directed towards the low pressure end of the compressor.

The axial forces acting on the rotors as a result of the pressure difference between the low pressure end and the high pressure end vary in magnitude during the compression stage, and said forces are distributed differently on the two rotors as a result of the mutual contact of the rotors between the flank surfaces of the lobes and the grooves. This distribution of the axially acting forces also varies during the compression stage. The force acting axially on each rotor will therefore be pulsating. When the compressor works under full load, the axially acting forces caused by the working medium are sufficiently large for the resultant force on each rotor to always remain directed towards the low pressure end, even if the magnitude of the force varies.

A compressor of this kind is conventionally relieved of load by throttling the inlet pressure significantly, down to about 0.1 bar, and, at the same time, lowering the pressure on the outlet side to about half the outlet pressure at full load.

When the compressor is driven free from load, the axial forces acting on the rotors in a direction towards the low pressure end, as described above, will be smaller, partly because the pressure difference between the outlet pressure and the inlet pressure is smaller and partly because the pressure in the bearing chamber of the high pressure end-section is lower. In this regard, there is a risk that these axial forces will not be large enough to ensure that the resultant force on each rotor will constantly be directed towards the low pressure end because of the above described force pulsations. The resultant axial force on a rotor can therefore change sign instantaneously, and act in a direction towards the high pressure end. This will result in vibration of one or both rotors in the axial direction. Rattling then occurs as the flanks of the rotors hit each other. These impacts damage the rotors and reduce the length of life of the bearing.

The rattling problem can be overcome by applying an axial force on one or both rotors in a direction towards the low pressure end of the compressor, while the problem caused by the high load on the thrust bearing of a rotor when the rotor is influenced axially from the high pressure side can be overcome by applying a force axially on one or both rotors in a direction towards the high pressure side of the machine.

SUMMARY OF THE INVENTION

An object of the present invention is to relieve the thrust bearings of helical rotor machines of the large axial forces in a simple and reliable fashion, or to counteract rattling with partial loads by applying to the rotors an axially directed force that acts in the opposite or same direction as the gas pressure acting through compression, respectively.

This has been achieved in accordance with the invention with helical screw rotor machines by placing around the one trunnion which has the axial thrust surface, with a close fit, a casing which has a generally circular, cylindrical outer surface and which is freely disposed in the chamber and has an outer end which is closed by a bottom wall that has a hole in its center, wherein the casing is rotatably mounted and axially displaceable on the trunnion through a given distance between a first axial position in which the bottom wall is spaced from a chamber end-wall, and a second axial position in which the bottom wall is in abutment with said end wall, and wherein a valve-equipped supply channel extending from a pressure medium source is connected to an opening in said end wall located opposite to the center hole in the bottom wall, for controlled delivery of pressure medium to the interior of the casing via the hole in the bottom wall thereof for transferring the casing from the first axial position to the second axial position while creating an overpressure inside the casing.

In one preferred embodiment, a ring-shaped sealing device is disposed between said end wall and the bottom wall surface of the casing facing the end wall, wherein the sealing device forms a circular sealing line whose diameter is smaller than the diameter of that part of the trunnion surrounded by the casing.

Other advantageous embodiments will be apparent from the detailed description.

Because, in accordance with the invention, pressure fluid can be delivered to the interior of the casing surrounding the end of the trunnion, the casing will be pressed against the end wall primarily by the dynamic pressure from the fluid. In the case of a ring-shaped sealing device, the abutment pressure against the end wall will depend on how much smaller the diameter of the sealing line is than the diameter of the trunnion pressure surface. One beneficial circumstance is that the casing adapts its radial position through the position of the trunnion, and that the pressure of the casing against the end wall ceases when the supply of pressure medium is stopped, so that the casing can begin to rotate together with the trunnion, in the absence of friction losses between the casing and the end wall or trunnion.

BRIEF DESCRIPTION OF THE DRAWINGS

The invention will now be described below in more detail with reference to various exemplifying embodiments of inventive arrangements and also with reference to the accompanying schematic drawings in which.

DETAILED DESCRIPTION

Figure 1A:
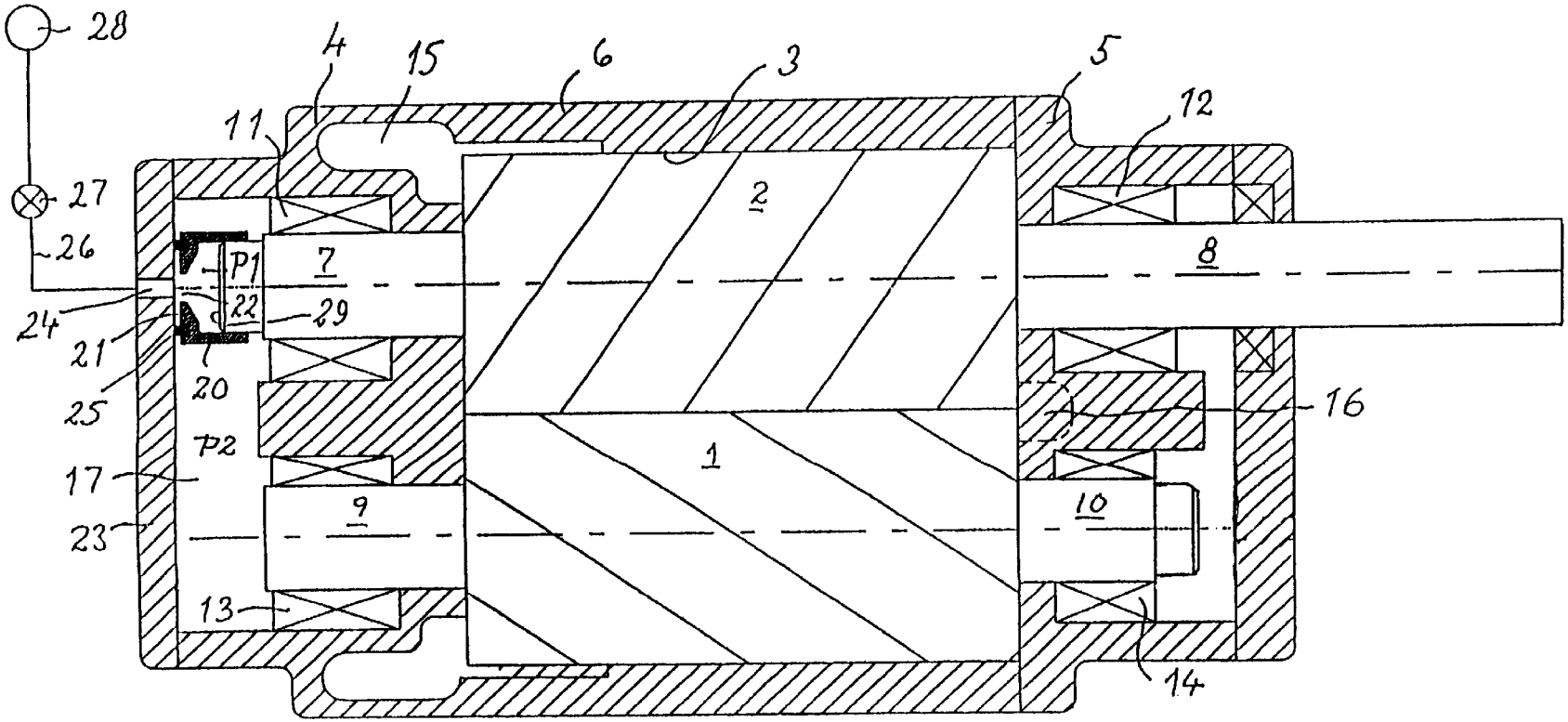
FIG. 1A is a longitudinal sectioned view of a helical screw compressor in accordance with one embodiment of the invention.

The compressor shown in FIG. 1A is intended for air compression and includes a male rotor 1 and a female rotor 2 provided conventionally with helically extending lobes and grooves (not shown) through which the rotors engage in one another and form working chambers in the working space 3 of the compressor. The working space is delimited by a low pressure end-section 4 and a high pressure end-section 5 and a barrel section 6 extending therebetween, said barrel section having the form of two mutually intersecting parallel cylinders. Each end of the rotors is provided with a respective trunnion 7, 8, 9, 10 carried by bearings 11, 12, 13, 14 in the two end-sections.

The compressor has an inlet port 15 at the low pressure end and an outlet port, indicated at 16, at the high pressure end. The bearings in the low pressure end-section 4 are disposed in a bearing chamber 17 in which a given pressure P2 prevails. The compressor is a so-called wet type, i.e. a liquid, normally oil, is delivered to the compressor with the aim of cooling, lubricating and sealing the same.

At full load, the compressor works with an inlet pressure that is equal to atmospheric pressure and the compressed air leaves the compressor at a pressure of about 8 bar. The pressure difference between the inlet and outlet end of the compressor results in a force that acts axially on each rotor 1, 2 in a direction towards the low pressure end. These forces are normally taken up by thrust bearings 12, 14 disposed in the high pressure end-section 5.

According to the invention, to enable the bearing 12 to be relieved of load, a casing is placed around the end of the trunnion 7 with a close fit, said casing having a cylindrical part 20 and a bottom wall 21. The casing 20, 21 is located in the chamber 17 and the casing interior communicates with said chamber through a hole 22 in the center of the bottom wall 21, which is parallel with an end wall 23 which closes the chamber 17 and which includes an opening 24 centrally opposite the hole 22 in the bottom wall 21. The bottom wall 21 converges internally towards the hole 22 and is provided with a ring-shaped sealing device 25, and the opening 24 in the end wall 23 has connected thereto a conduit means 26 which forms a delivery channel equipped with a valve 27 and extending from a pressure medium source 28. The pressure medium source 28 may be an oil separator and the pressure medium may be oil.

The bearing 12 is relieved of load by opening the valve 27 and passing the pressure medium from the source 28 through the conduit means 26 into the interior of the casing 20, 21 via the opening 24 and the hole 22.

The inflowing pressure medium exerts a dynamic pressure on the casing interior, so as to move the casing into sealing abutment with the end wall 23 by virtue of the sealing device 25.

The pressure source 28 creates in the interior of the casing a pressure P1 that is greater than the pressure P2 in the chamber 17.

Figure 2:
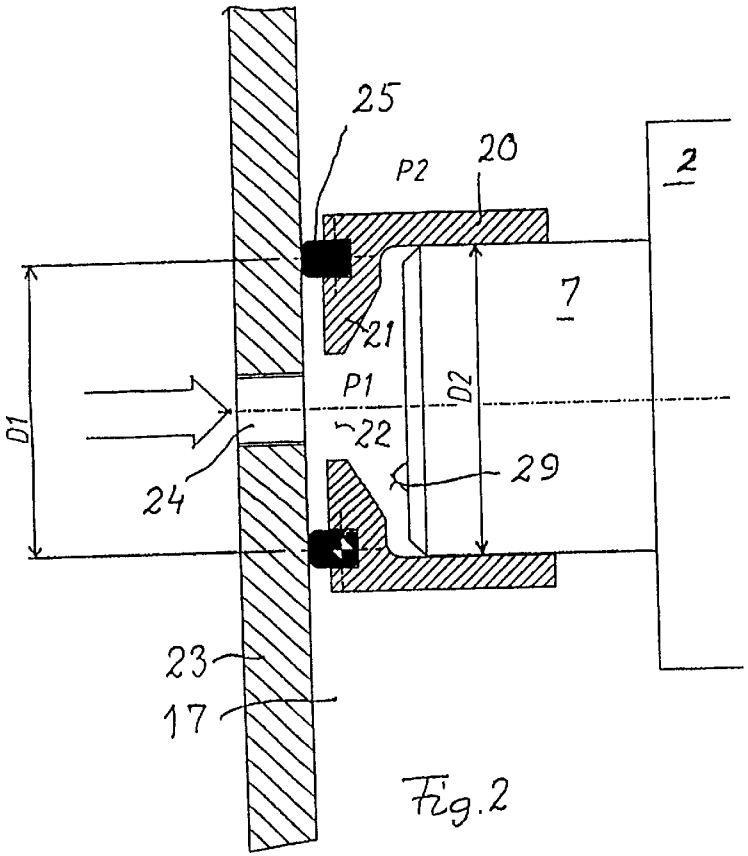
FIG. 2 is a longitudinal sectioned view of a casing mounted on a trunnion and lying against an end wall, of which a part is shown in section.

The sealing element 25 is circular and defines a closed sealing line with an enclosed area that is smaller than the end surface 29 of the trunnion 7, as will be apparent from FIG. 2 where the diameter D1 of the sealing line is slightly smaller than the diameter of the trunnion and therewith also smaller than the inner diameter D2 of the casing 20, 21. Thus, the pressure medium of pressure P1 exerts a force partly on the inner walls of the casing on the one hand, so as to press the casing against the end wall 23, and on the end surface 29 of the trunnion 7 on the other hand, so as to urge the rotor 2 towards the high pressure end-section 5 while relieving the bearing 12 of load.

Figure 3:
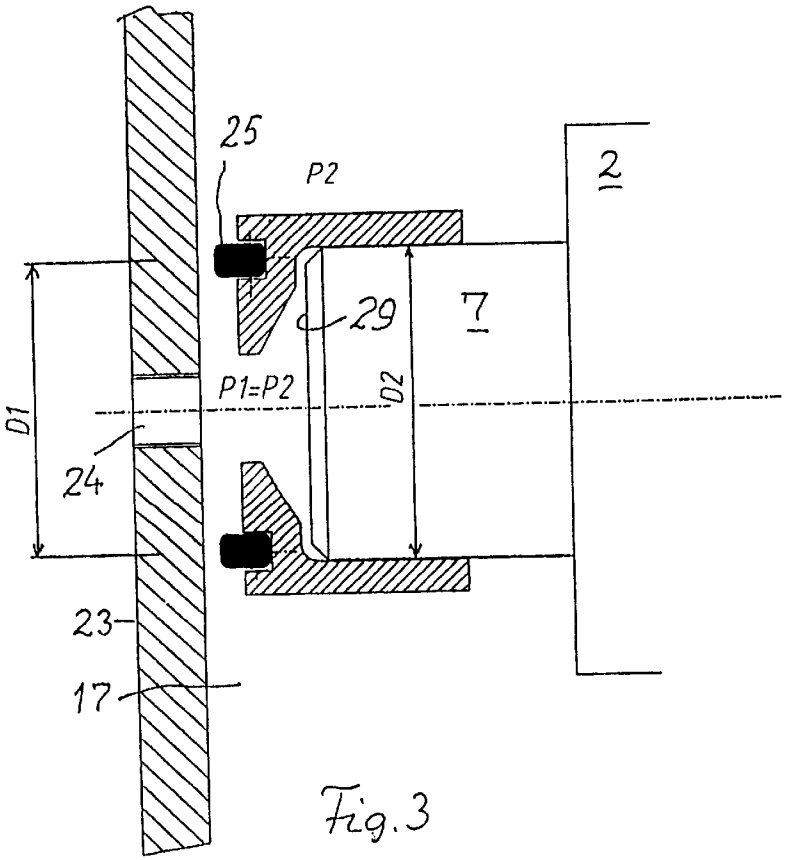
FIG. 3 is the same sectional view as that shown in FIG. 2, but with the casing released from the end wall.

In the illustrated case, the trunnion 7 rotates in the non-rotating casing 20, 21, which is guided radially to a correct position by the trunnion 7. When the valve 27 is then closed, the pressure P1 in the interior of the casing 20, 21 will fall, and the abutment of the casing with the end-wall 23 ceases and the pressure in the casing becomes equal to the ambient pressure P2. The casing will then begin to rotate together with rotation of the trunnion 7, such that all friction and wear on the casing and the trunnion 7 ceases, as is evident from FIG. 3. The rotating casing 20, 21 can be prevented from impact with the end-wall 23 by providing these elements with mutually repelling, ring-shaped magnetic devices 40, 41, as shown in FIG. 4.

Figure 4:
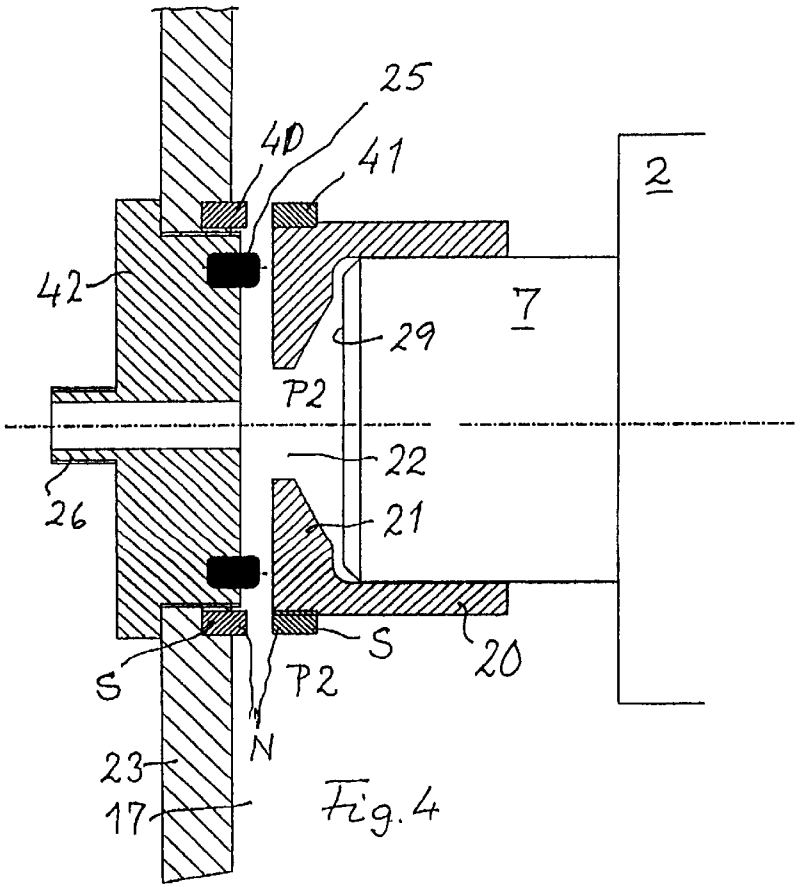
FIG. 4 is the same sectional view as that in FIG. 2, but with the sealing ring mounted on the end wall.

As shown in FIG. 4, the circular sealing element 25 may conveniently be affixed to the end-wall 23 instead of to the casing bottom wall 21. In the case of this latter alternative, the sealing element may conveniently be affixed to a bushing 42 that can be screwed into the end-wall from without, thereby facilitating the replacement of a worn sealing element 25.

Figure 5:
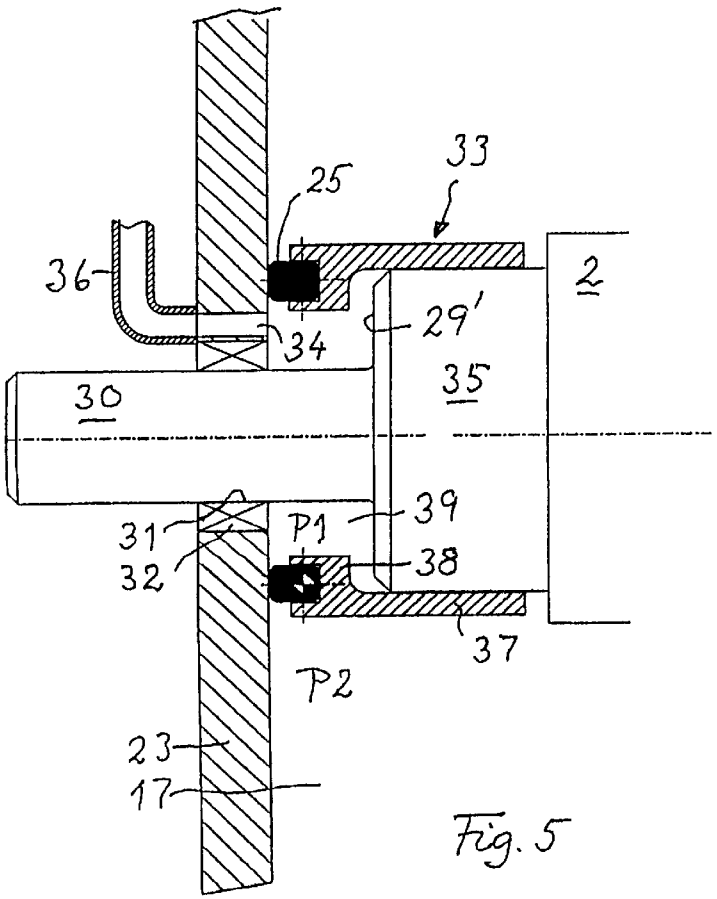
FIG. 5 is a longitudinal sectioned view of a casing that is modified for mounting on an extended trunnion.

The invention can also be applied when a trunnion 30 is extended through a hole 31 with a shaft seal 32 in the end-wall 23, as shown in FIG. 5.

If it is desired to obtain in the embodiment shown in FIG. 5 a pressure surface of the same area as the end surface 29 of the trunnion 7 in FIG. 2, it is necessary to increase the diameter of the trunnion 30 with the aid of a thrust collar 35 so as to obtain an axially projected, ring-shaped end surface 29' whose area is the same as the area of the end-surface 29 in FIG. 2. A casing 33 is mounted on the collar 35 with a close fit, in the manner earlier described. The end-wall 23 has disposed around the trunnion seal 32 openings 34 that accommodate pipes 36 leading to a pressure medium source not shown. The casing 33 includes a cylindrical part 37 and a bottom wall 38 that has a center hole 39 of sufficiently large diameter to allow the opening or openings 34 to discharge inwardly of the periphery of the center hole 39.

Figure 1B:
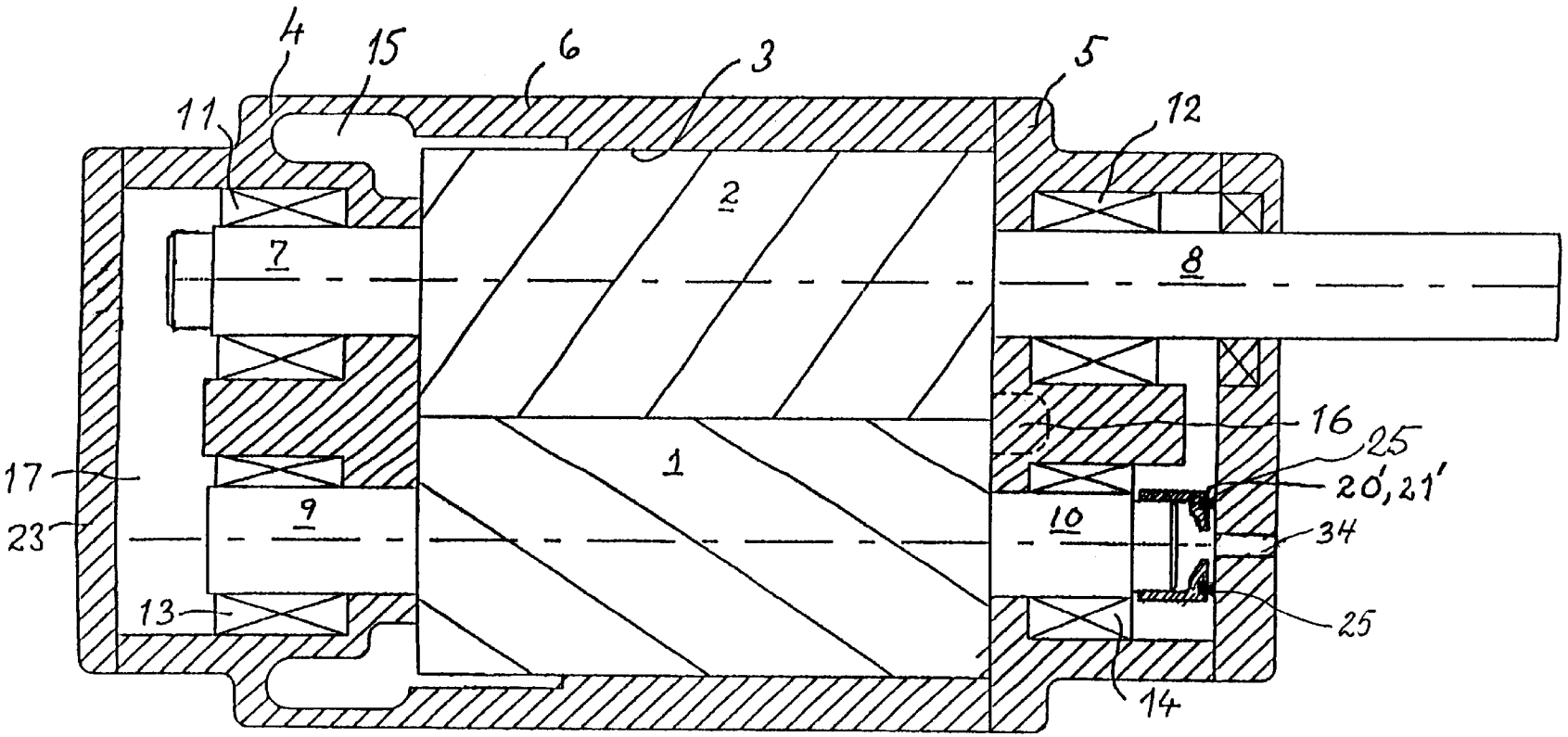
FIG. 1B is a longitudinal sectioned view of a helical screw compressor in accordance with another embodiment of the invention.

When the invention is intended to eliminate rattling, a casing 20, 21 is fitted to the end of the trunnion 10 in a manner corresponding to that described above, and the opening 34 is arranged in an adjacent end-wall, as shown in FIG. 1B.

It will be understood that the invention is not restricted to the illustrated and described embodiments thereof and that various modifications can be made within the scope of the invention defined in the accompanying claims. For instance, the casing 20, 21 may be produced with a material on the outside of the bottom wall 21 that is elastic and flat, so that the sealing function can be obtained without the use of a separate sealing element. The same applies to the inside of the end-wall 23 opposite the casing 20, 21. And naturally, the trunnion 9 may also be provided with load relieving means in accordance with the invention.

In order to prevent the casing 20, 21 or 33, which is co-rotational with the trunnion, from hitting the end wall 23 when the pressure inside the casing is equal to the pressure externally thereof, the end wall 23 and respective bottom walls 21, 38 of the casing may each be provided with a ring-shaped magnet 40, 41 so arranged and magnetized as to repel each other and thus temporarily contribute to maintain the intended interspace between the end wall and the bottom wall of the casing, similar to what is shown in FIG. 4 with regard to the casing 20, 21.

I claim:

1. A helical screw rotor machine for compressing or expanding a pressure medium, said helical screw rotor machine comprising:

a housing in which at least one rotor provided with trunnions is enclosed in a working space that includes an inlet port and an outlet port, wherein the working space is delimited by a low pressure end-section, a high pressure end-section and a barrel section extending between said end-sections, wherein the trunnions extend into bearings disposed in the end-sections, and wherein at least one of the trunnions extends through an associated end-section and presents an axially projected thrust surface in a delimited chamber which contains means for creating a force that acts axially on said thrust surface; and a casing closely fitted around said at least one trunnion, wherein the casing has a generally circular-cylindrical outer surface and is freely disposed in the chamber and has an outer end which is closed by a bottom wall having a center hole in a center portion, and wherein the casing is rotatably mounted on and axially displaceable along said at least one trunnion through a given distance between a first axial position in which the bottom wall is spaced from an end wall of the chamber and a second axial position in which the bottom wall is in abutment with said end wall; and a supply channel provided with a valve and extending from a pressure medium source, wherein said supply channel is connected to an opening in the end wall of the chamber opposite the center hole of the bottom wall of the casing for controlled delivery of the pressure medium into the casing via the center hole for moving the casing from said first axial position to said second axial position while creating an overpressure within the chamber.

2. A rotor machine according to claim 1, further comprising a ring-shaped sealing element provided between the end wall of the chamber and the bottom wall of the casing facing towards said end wall, wherein said sealing element defines a circular sealing line whose diameter is smaller than a diameter of a part of the trunnion surrounded by the casing.

3. A rotor machine according to claim 2, wherein the sealing element is affixed to the bottom wall of the casing.

4. A rotor machine according to claim 2, wherein the sealing element is affixed to the end wall of the chamber.

5. A rotor machine according to claim 3, wherein the sealing element is mounted on a bushing which is adapted to be inserted into the end wall of the chamber, and in which the opening for the supply of the pressure medium is arranged.

6. A rotor machine according to claim 1, wherein the bottom wall of the casing converges internally towards the center hole in said casing.

7. A rotor machine according to claim 2, wherein the bottom wall of the casing converges internally towards the center hole in said casing.

8. A rotor machine according to claim 3, wherein the bottom wall of the casing converges internally towards the center hole in said casing.

9. A rotor machine according to claim 4, wherein the bottom wall of the casing converges internally towards the center hole in said casing.

10. A rotor machine according to claim 5, wherein the bottom wall of the casing converges internally towards the center hole in said casing.

11. A rotor machine according claim 1, wherein the end wall of the chamber and the bottom wall of the casing are each provided with mutually repelling magnetic elements.

12. A rotor machine according claim 2, wherein the end wall of the chamber and the bottom wall of the casing are each provided with mutually repelling magnetic elements.

13. A rotor machine according claim 3, wherein the end wall of the chamber and the bottom wall of the casing are each provided with mutually repelling magnetic elements.

14. A rotor machine according claim 4, wherein the end wall of the chamber and the bottom wall of the casing are each provided with mutually repelling magnetic elements.

15. A rotor machine according claim 5, wherein the end wall of the chamber and the bottom wall of the casing are each provided with mutually repelling magnetic elements.

16. A rotor machine according to claim 1, wherein the pressure medium is oil and the pressure medium source is an oil separator connected to the rotor machine.

17. A rotor machine according to claim 2, wherein the pressure medium is oil and the pressure medium source is an oil separator connected to the rotor machine.

18. A rotor machine according to claim 3, wherein the pressure medium is oil and the pressure medium source is an oil separator connected to the rotor machine.

19. A rotor machine according to claim 4, wherein the pressure medium is oil and the pressure medium source is an oil separator connected to the rotor machine.

20. A rotor machine according to claim 5, wherein the pressure medium is oil and the pressure medium source is an oil separator connected to the rotor machine.

* * * * *